US007562930B1

(12) United States Patent
Rondeau

(10) Patent No.: US 7,562,930 B1
(45) Date of Patent: Jul. 21, 2009

(54) COMBINATION UMBRELLA AND FOLDING CHAIR AND ASSOCIATED METHOD

(76) Inventor: Amanda J. Rondeau, Box 7104 Bonnyville, Alberta (CA) T9N 2H4

( * ) Notice: Subject to any disclaimer, the term of this patent is extended or adjusted under 35 U.S.C. 154(b) by 0 days.

(21) Appl. No.: 12/152,402

(22) Filed: May 14, 2008

(51) Int. Cl.
*A47C 29/00* (2006.01)
*A47C 7/62* (2006.01)
*A47C 4/28* (2006.01)

(52) U.S. Cl. ..... 297/184.16; 297/188.01; 297/45

(58) Field of Classification Search ..... 135/96, 135/98; 297/184.16, 184.15, 188.01, 17, 297/45, 16.2, 217.1
See application file for complete search history.

(56) References Cited

U.S. PATENT DOCUMENTS 3,677,571 A * 7/1972 Maturo et al. ..... 280/654
5,139,308 A * 8/1992 Ziman ..... 297/188.06
5,301,999 A * 4/1994 Thompson et al. ..... 297/184.13
6,439,659 B1 * 8/2002 Neubauer, Jr. ..... 297/188.01
6,666,221 B1 * 12/2003 Booth ..... 135/16
7,226,126 B1 * 6/2007 Spanovich ..... 297/184.16

* cited by examiner

*Primary Examiner*—Milton Nelson, Jr.

(57) ABSTRACT

The combination umbrella and folding chair includes an umbrella section with first and second rectilinear poles with axially opposed top and bottom ends respectively. The umbrella section further includes a rotatable knob that allows the user to maintain the second pole in a fixed position and a circular and flexible covering. The assembly further includes a chair section with a flexible and planar seat member, a flexible and planar backrest, and a ring-shaped cup holder. The assembly further includes a mechanism for storing and transporting the umbrella section and the chair section simultaneously.

12 Claims, 8 Drawing Sheets

COMBINATION UMBRELLA AND FOLDING CHAIR AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to umbrellas and, more particularly, to a combination umbrella and folding chair for providing a barrier between a user and the sun or rain while the user employs the chair in outdoor environments.

2. Prior Art

Beach chairs provide temporary places for people to sit and rest when they are camping, fishing or playing on a beach. To prevent sunburns and receiving excessive rays from the sun, most beach chairs are equipped with a sunshade. A conventional foldable beach chair includes a seat, a backrest, legs, armrests and a sunshade. The backrest usually includes a U-shaped tubular frame with a horizontal top and two essentially vertical sides. The sunshade has a shaft and a securing device that clamps on or otherwise attaches to the tubular frame. The seat, the backrest, the legs and the armrests are connected together to form a chair body and are foldable so the chair can be stored or carried easily. The sunshade is attached to the top of the backrest frame by the securing device.

U.S. Pat. No. 6,666,221 to Booth discloses a chair seat portion and a chair back portion and an umbrella assembly adapted for mounting on the chair back portion. The umbrella assembly includes a receiver tube adapted for receiving an umbrella post to support the umbrella in an upright attitude. The receiver tube provides a pair of L-shaped ears extending from an exterior surface, and the chair back portion provides a mounting block engaged on a rear surface of the chair back portion. The mounting block is adapted for receiving the pair of L-shaped ears within a corresponding pair of L-shaped holes within the mounting block so as to stabilize the umbrella assembly on the chair. Unfortunately, this prior art example does not include a cup holder and a means for folding the entire assembly into a single transportable container.

U.S. Pat. No. 6,234,187 to Izzo discloses an adjustable umbrella apparatus comprised of an umbrella with a canopy and a rod. A connector is attached to the rod and has a pair of prongs extending therefrom. The connector is disposed within a channel formed in an umbrella base. The connector prongs are spring-loaded relative to the connector body within the channel and, when released, the prongs are urged through corresponding lock holes to retain the umbrella in a desired position relative to the umbrella base. When the spring-loaded prongs are compressed, the connector may be slid within the channel longitudinally or rotatably relative to the longitudinal axis of the channel. In this manner, the umbrella may be adjusted longitudinally and rotatably to a chosen orientation and held securely in place in that chosen orientation. The umbrella base is formed integral with or attachable to a framed chair such as a beach chair. Unfortunately, this prior art example does not provide an umbrella and beach chair in one convenient assembly.

U.S. Pat. No. 5,255,954 to Rogers discloses a chair back connected umbrella support that is formed by an open frame and vertically supported by an elongated sleeve that slidably receives the shank of an umbrella. The frame is removably supported by an inclined chair back by J-shaped hooks connected therewith and the umbrella shank receiving sleeve is disposed substantially vertically by a pair of tubes projecting laterally of the frame and nested by sockets connected with the chair back below the J-shaped hooks. A cam lever engages the umbrella shank and vertically adjustably supports the umbrella relative to the chair and the occupant therein.

Accordingly, the present invention is disclosed in order to overcome the above noted shortcomings. The present invention satisfies such a need by providing an assembly that is convenient and easy to use, lightweight yet durable in design, and designed for providing a barrier between a user and the sun or rain while the user employs the chair in outdoor environments. The combination umbrella and folding chair is advantageously designed to allow a user to conveniently have all the pieces necessary for relaxing outdoors in one assembly. The umbrella and folding chair allows a user to raise or lower the umbrella as desired by a user, while also providing a means for storing a beverage within a user's reach. The umbrella and folding chair is also designed for allowing a user to relax in the chair with their feet in the water. The present invention is simple to use, inexpensive, and designed for many years of repeated use.

BRIEF SUMMARY OF THE INVENTION

In view of the foregoing background, it is therefore an object of the present invention to provide a means for providing a barrier between a user and the sun or rain while the user employs the chair in outdoor environments. These and other objects, features, and advantages of the invention are provided by a combination umbrella and folding chair.

The combination umbrella and folding chair includes an umbrella section. Such an umbrella section includes first and second rectilinear poles with axially opposed top and bottom ends respectively. Such a top end of the first pole is hingedly attached directly to the bottom end of the second pole, and such a bottom end of the second pole effectively locks into the top end of the first pole when the top end of the second pole is biased upwardly and away from the top end of the first pole. The second pole is biased 180 degrees along an arcuate path defined about the hinged attachment point.

The umbrella section further includes a rotatable knob directly and simultaneously attached to the top end of the first pole and the bottom end of the second pole. Such a knob conveniently allows the user to maintain the second pole in a fixed position at a multitude of discrete points along the arcuate path. Respective longitudinal lengths of the first and second poles are oriented collectively along a vertical plane such that the first and second poles are attached in an end-to-end sequence during operating conditions. The first and second poles advantageously abut directly against each other along the respective longitudinal lengths thereof when the top end of the second pole is biased downwardly and toward the bottom end of the first section for storage and transport purposes. The umbrella section further includes a circular and flexible covering provided with a center region statically connected to the top end of the second pole. Such a covering has an outer circumference equidistantly spaced from the center region of the covering and the top end of the second pole respectively.

The assembly further includes a chair section directly attached to the umbrella section. Such a chair section includes first, second, and third vertical support members. Such a first vertical support member with a longitudinal length equal to the longitudinal length of the first pole of the umbrella section, and each of the second and third vertical support members effectively have equal longitudinal lengths that are less than the respective longitudinal lengths of the first pole and the first vertical support. The chair section further includes first and second horizontal support members with axially opposed proximal and distal ends respectively and equal longitudinal lengths. Such a proximal end of the first horizontal support member is hingedly attached to the first vertical support member while the proximal end of the second horizontal support member is telescopically and hingedly attached to the first pole of the umbrella section. Such a distal end of the first horizontal support member is hingedly attached to a top end of the second vertical support member while the distal end of the second horizontal support member is hingedly attached to a top end of the third vertical support member.

The chair section further includes first and second crossed support members pivotally attached to each other at respective medial portions thereof. Each of such first and second cross members conveniently have equal longitudinal lengths respectively, and each of the first and second cross members have axially opposed top and bottom ends respectively. The top end of the first cross member is telescopically and hingedly attached to the first pole of the umbrella section. Such an attachment is advantageously above the attachment of the proximal end of the second horizontal support member and abutted directly thereagainst. The bottom end of the first cross member is detachably connected to a bottom end of the second vertical support member. The top end of the second cross member is hingedly attached to the top end of the third vertical support member. Such an attachment is subjacent to the attachment of the distal end of the second horizontal support member and abutted directly thereagainst, and the bottom end of the second cross member is hingedly attached to a bottom end of the first vertical support member.

The chair section further includes a flexible and planar seat member with axially opposed corners simultaneously connected to the first pole of the umbrella section and the first, second, and third vertical support members respectively such that the seat member spans therebetween during operating conditions. Such a seat member effectively has a top surface in contact with the user body when the user is seated thereupon, and such a top surface is maintained along a horizontal plane during operating conditions. The first pole of the umbrella section and the first, second, and third vertical supports respectively are spaced from each other at a distance defined by the respective longitudinal lengths of the first and second horizontal support members and the respective longitudinal lengths of the first and second cross members respectively during operating conditions, and the first and second horizontal support members are spaced above a ground surface a distance defined by the respective longitudinal lengths of the second and third vertical support members and the respective lengths of the first and second cross members during operating conditions.

The chair section further includes a flexible and planar backrest provided with longitudinally opposed left and right ends. Each of such left and right ends conveniently has a sleeve formed therein and extending along an entire lateral width thereof, and the first vertical support member is slidably interfitted within the sleeve of the left end of the backrest while the first pole of the umbrella section is slidably interfitted within the sleeve of the right end of the back rest such that the backrest spans between the first vertical support member and the first pole of the umbrella section. The chair section further includes a ring-shaped cup holder monolithically formed with an outer surface of the second horizontal support member and spaced from the seat member. Such a cup holder is advantageously located adjacent to the distal end of the second horizontal support member, and the cup holder further has an opening formed therein such that existing beverage containers of different sizes are nested therein during operating conditions. Such an opening of the cup holder has a centrally registered axis oriented parallel with the vertical plane during operating conditions.

The assembly further includes a mechanism for storing and transporting the umbrella section and the chair section simultaneously. Such a storing and transporting mechanism is effectively detachable from the umbrella section and the chair section respectively during operating conditions. The storing and transporting mechanism includes a deformably resilient and flexible bag with an open top end. Such an open top end allows the apparatus to be introduced into an interior of the bag, and the bag conveniently is suitably shaped and sized such that the apparatus is surrounded by the bag when the apparatus is introduced into the interior thereof during storage and transport procedures respectively. The second pole is abutted directly against the first pole along the respective longitudinal lengths thereof and the chair section is in the collapsed position prior to introducing the apparatus into the interior of the bag.

The storing and transporting mechanism further includes a drawstring slidably attached to an outside surface of the open top end of the bag. Such a drawstring advantageously maintains the open top end in a closed position when the apparatus is introduced into the interior of the bag such that the apparatus is prohibited from prematurely and undesirably exiting the interior of the bag during storage and transport procedures respectively. The bottom end of the second vertical support member is effectively detached from the bottom end of the second cross member and the first horizontal support member and the second vertical support member respectively are simultaneously articulated upwardly and toward the first vertical support member while the second horizontal support member and the third vertical support member respectively are simultaneously articulated upwardly and toward the first pole of the umbrella section.

The first and second vertical support members and the first horizontal support member respectively are conveniently forced toward the first pole of the umbrella section and the second horizontal support member and the third vertical support member respectively such that the chair section is in the collapsed position. The umbrella section and the chair section respectively abut against each other along respective longitudinal lengths thereof such that the apparatus is introduced to the interior of the bag during storage and transport procedures respectively.

A method for providing a barrier between a user and the sun or rain via a combination umbrella and folding chair employed in outdoor environments includes the steps of: providing an umbrella section; attaching a chair section directly to the umbrella section; and storing and transporting the umbrella section and the chair section simultaneously. The storing and transporting mechanism is detachable from the umbrella section and the chair section respectively during operating conditions.

The method further includes the steps of: hingedly attaching a top end of a first rectilinear pole directly to a bottom end of a second rectilinear pole and locking the bottom end of the second pole into the top end of the first pole when the top end of the second pole is biased upwardly and away from the top end of the first pole. Such a second pole is biased 180 degrees along an arcuate path defined about the hinged attachment point. The steps further include attaching a rotatable knob directly and simultaneously to the top end of the first pole and the bottom end of the second pole. Such a knob allows the user to maintain the second pole in a fixed position at a multitude of discrete points along the arcuate path.

The steps further include connecting a circular and flexible covering provided with a center region to the top end of the second pole. Such a covering has an outer circumference equidistantly spaced from the center region of the covering and the top end of the second pole respectively, and respective longitudinal lengths of the first and second poles are oriented collectively along a vertical plane such that the first and second poles are attached in an end-to-end sequence during operating conditions. The first and second poles abut directly against each other along the respective longitudinal lengths thereof when the top end of the second pole is biased downwardly and toward the bottom end of the first section for storage and transport purposes.

The method further includes the steps of providing first, second, and third vertical support members. Such a first vertical support member has a longitudinal length equal to the longitudinal length of the first pole of the umbrella section, and each of such second and third vertical support members have equal longitudinal lengths that are less than the respective longitudinal lengths of the first pole and the first vertical support. The steps further include providing first and second horizontal support members with axially opposed proximal and distal ends respectively and equal longitudinal lengths. Such a proximal end of the first horizontal support member is hingedly attached to the first vertical support member while the proximal end of the second horizontal support member is telescopically and hingedly attached to the first pole of the umbrella section, and such a distal end of the first horizontal support member is hingedly attached to a top end of the second vertical support member while the distal end of the second horizontal support member is hingedly attached to a top end of the third vertical support member.

The steps further include providing first and second crossed support members pivotally attached to each other at respective medial portions thereof. Each of such first and second cross members have equal longitudinal lengths respectively, and each of the first and second cross members further have axially opposed top and bottom ends respectively. The steps further include providing a flexible and planar seat member with axially opposed corners simultaneously connected to the first pole of the umbrella section and the first, second, and third vertical support members respectively such that the seat member spans therebetween during operating conditions. Such a seat member has a top surface in contact with the user body when the user is seated thereupon, and such a top surface is maintained along a horizontal plane during operating conditions. The seat member further includes a bottom portion in contact with a ground surface, which is provided for preventing the assembly from sinking into the ground surface when the invention is utilized at a beach setting. Such a bottom portion further helps keep the assembly afloat when positioned in body of water.

The top end of the first cross member is telescopically and hingedly attached to the first pole of the umbrella section. Such an attachment is above the attachment of the proximal end of the second horizontal support member and abutted directly thereagainst, and the bottom end of the first cross member is detachably connected to a bottom end of the second vertical support member. The top end of the second cross member is hingedly attached to the top end of the third vertical support member. Such an attachment is subjacent to the attachment of the distal end of the second horizontal support member and abutted directly thereagainst, and the bottom end of the second cross member is hingedly attached to a bottom end of the first vertical support member.

The first pole of the umbrella section and the first, second, and third vertical supports respectively are spaced from each other at a distance defined by the respective longitudinal lengths of the first and second horizontal support members and the respective longitudinal lengths of the first and second cross members respectively during operating conditions. The first and second horizontal support members are spaced above a ground surface a distance defined by the respective longitudinal lengths of the second and third vertical support members and the respective lengths of the first and second cross members during operating conditions.

The method further includes the steps of providing a flexible and planar backrest with longitudinally opposed left and right ends. Each of such left and right ends has a sleeve formed therein and extending along an entire lateral width thereof. The steps further include interfitting the first vertical support member within the sleeve of the left end of the backrest and interfitting the first pole of the umbrella section within the sleeve of the right end of the back rest such that the backrest spans between the first vertical support member and the first pole of the umbrella section.

The method further includes the steps of providing a ring-shaped cup holder monolithically formed with an outer surface of the second horizontal support member and spaced from the seat member. Such a cup holder is located adjacent to the distal end of the second horizontal support member. The steps further include nesting an existing beverage container within the cup holder. The cup holder has an opening formed therein with a centrally registered axis oriented parallel with the vertical plane during operating conditions.

The method further includes the steps of: providing a deformably resilient and flexible bag with an open top end and introducing the apparatus through the open top end of the bag and into an interior of the bag. Such a bag is suitably shaped and sized such that the apparatus is surrounded by the bag when the apparatus is introduced into the interior thereof during storage and transport procedures respectively. The steps further include attaching a slidable drawstring to an outside surface of the open top end of the bag. Such a drawstring maintains the open top end in a closed position when the apparatus is introduced into the interior of the bag such that the apparatus is prohibited from prematurely and undesirably exiting the interior of the bag during storage and transport procedures respectively.

The second pole is abutted directly against the first pole along the respective longitudinal lengths thereof and the chair section is in the collapsed position prior to introducing the apparatus into the interior of the bag. The bottom end of the second vertical support member is detached from the bottom end of the second cross member and the first horizontal support member and the second vertical support member respectively are simultaneously articulated upwardly and toward the first vertical support member while the second horizontal support member and the third vertical support member respectively are simultaneously articulated upwardly and toward the first pole of the umbrella section. The first and second vertical support members and the first horizontal support member respectively are forced toward the first pole of the umbrella section and the second horizontal support member and the third vertical support member respectively such that the chair section is in the collapsed position. The umbrella section and the chair section respectively abut against each other along respective longitudinal lengths thereof such that the apparatus is introduced to the interior of the bag during storage and transport procedures respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
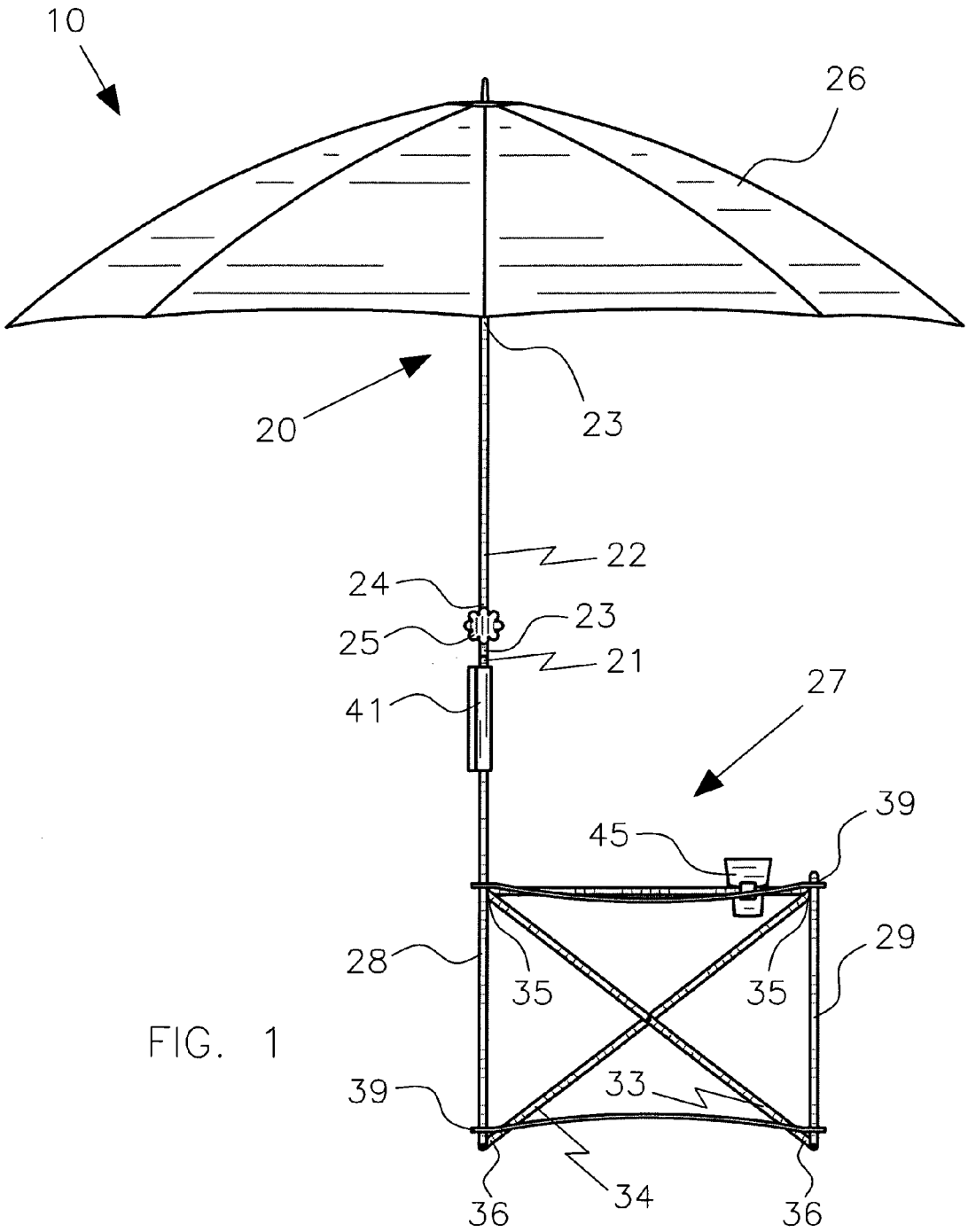
FIG. 1 is a side elevational view of a combination umbrella and folding chair, in accordance with the present invention.
Figure 2:
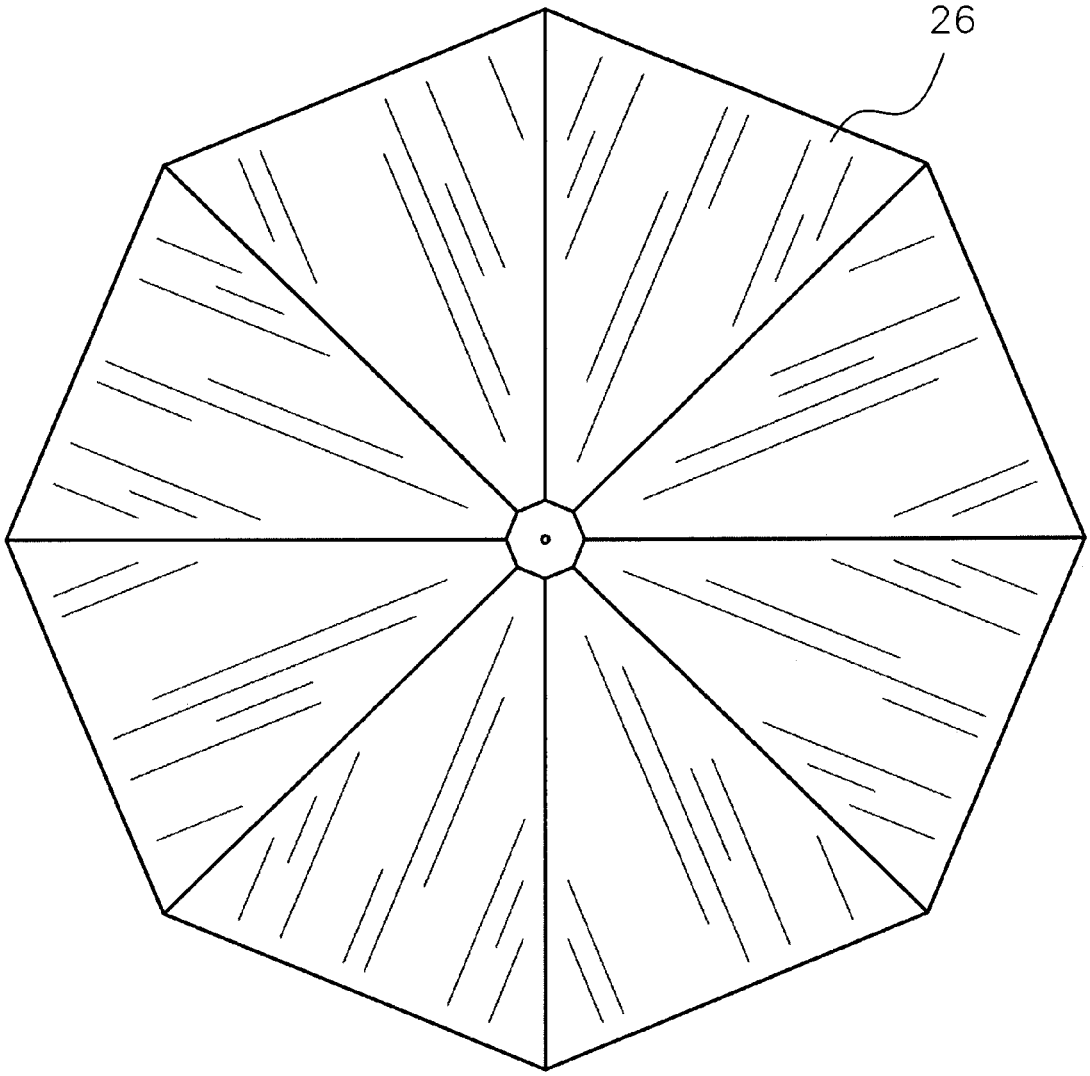
FIG. 2 is a top planar view of the circular and flexible cover of the umbrella section, in accordance with the present invention.
Figure 3:
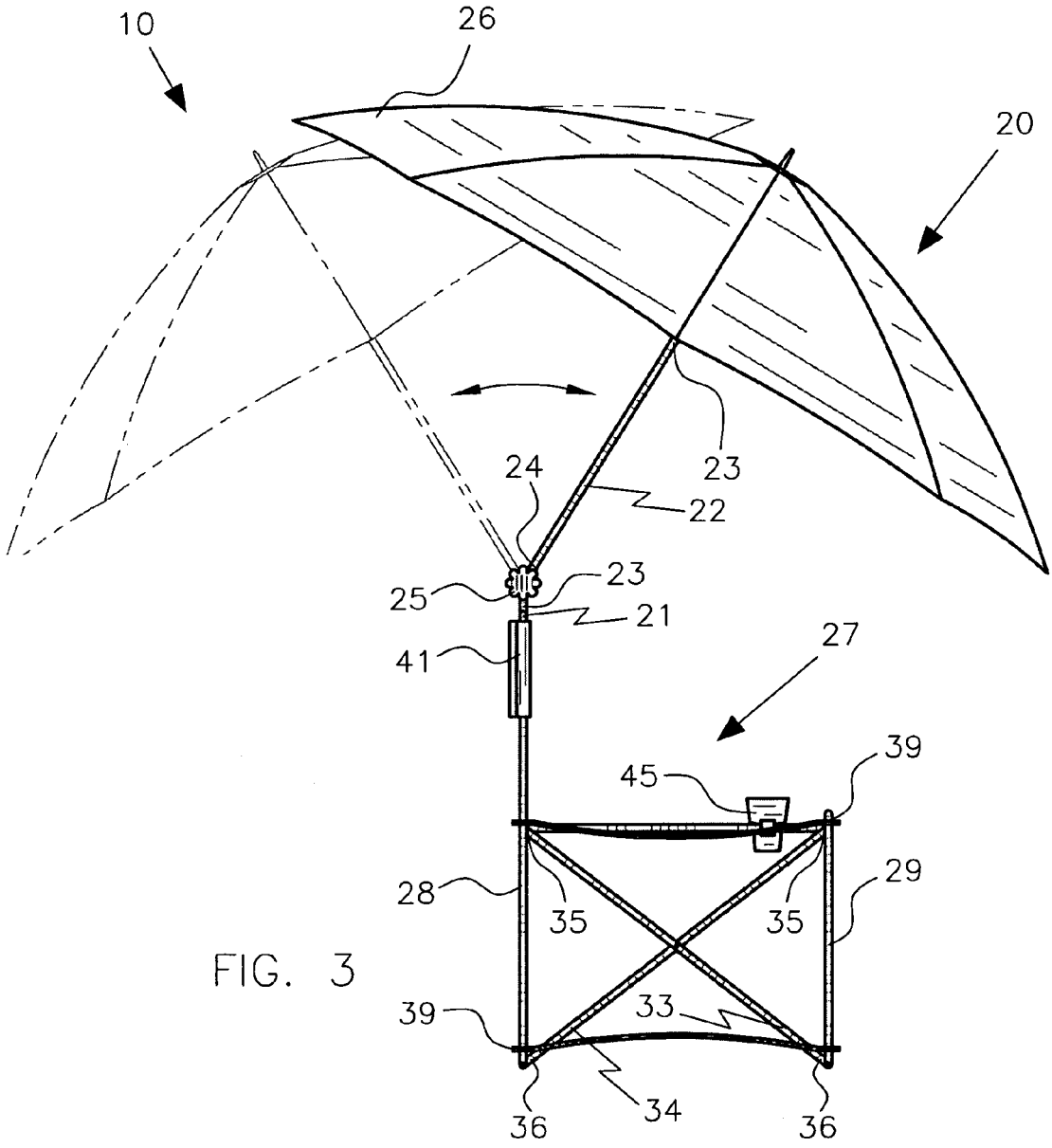
FIG. 3 is a side elevational view of a combination and folding chair showing the hinged movements of the umbrella section, in accordance with the present invention.
Figure 4:
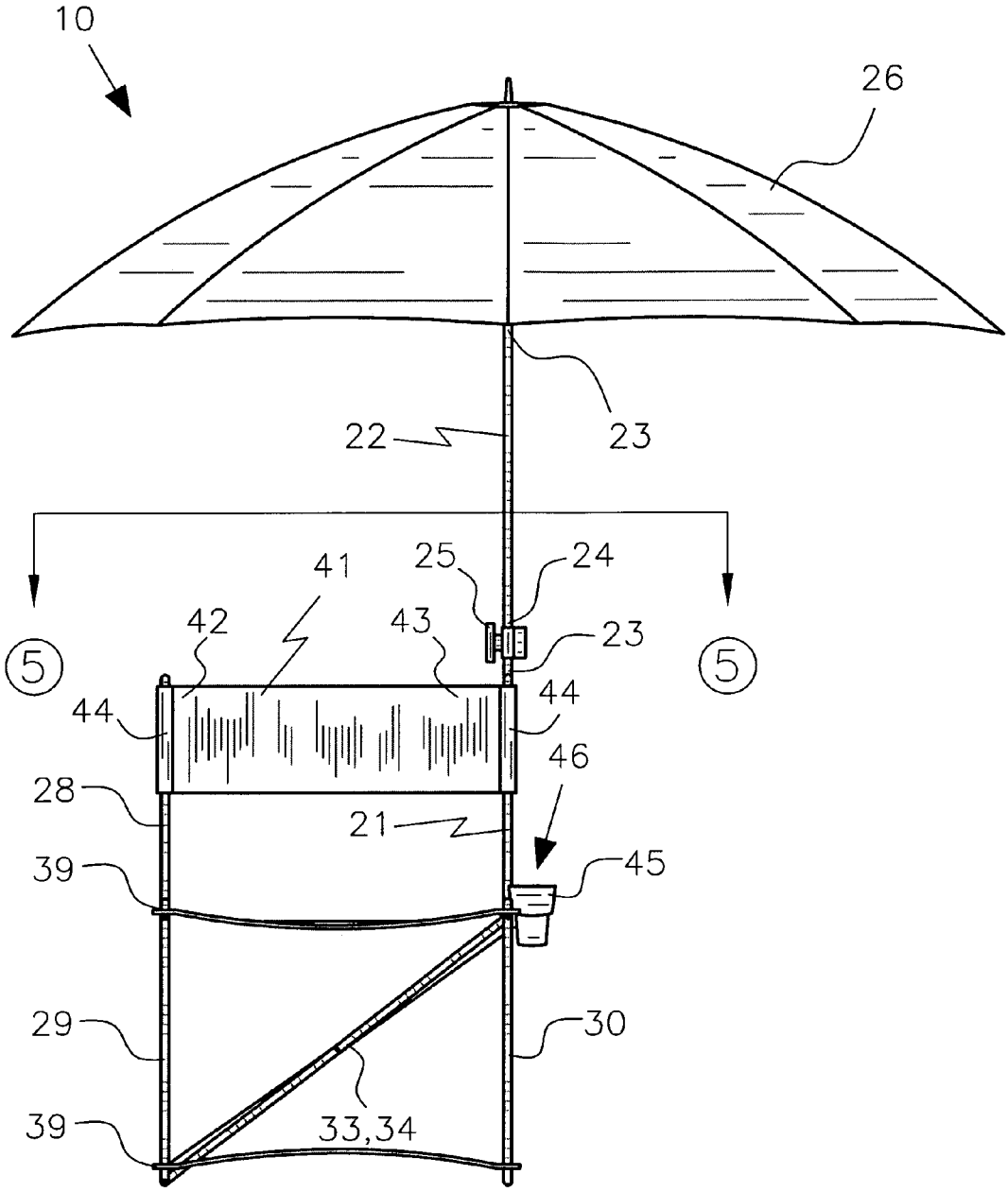
FIG. 4 is a front elevational view of a combination umbrella and folding chair, in accordance with the present invention.
Figure 5:
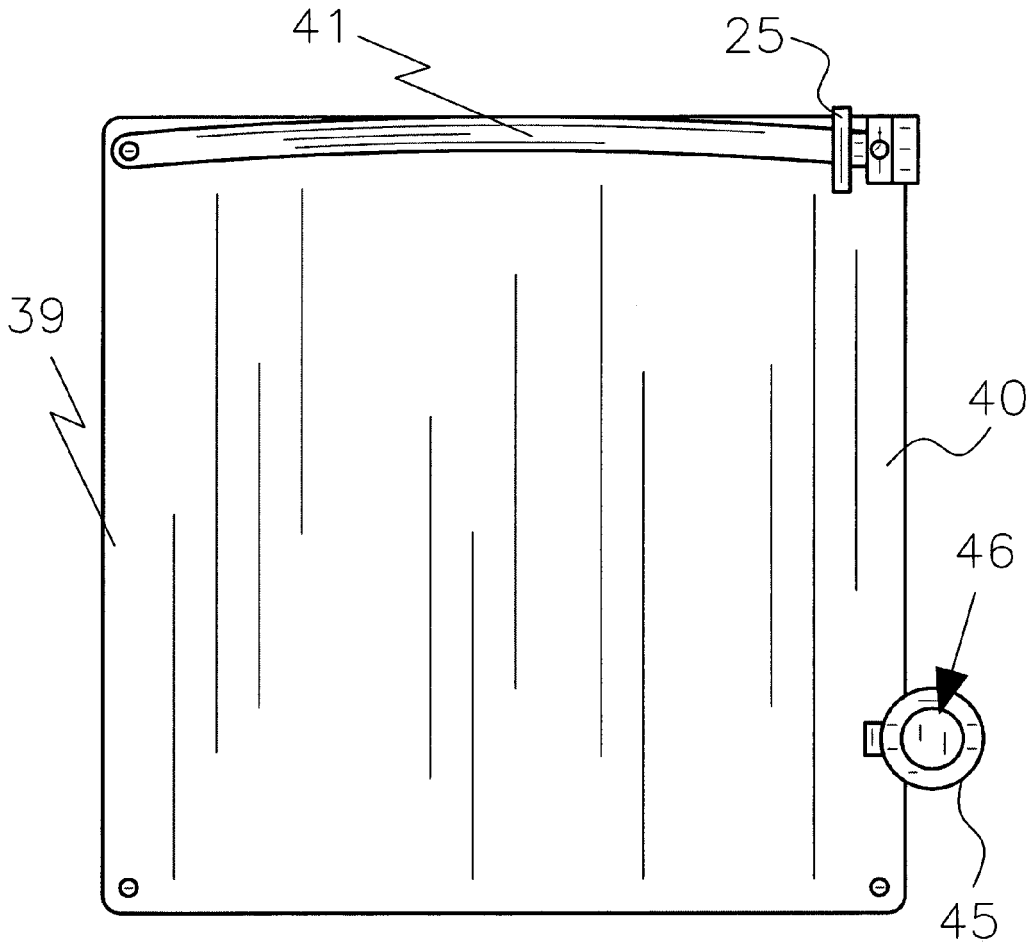
FIG. 5 is a cross sectional view of a combination umbrella and folding chair, taken along line 5-5 as shown in FIG. 4.
Figure 6:
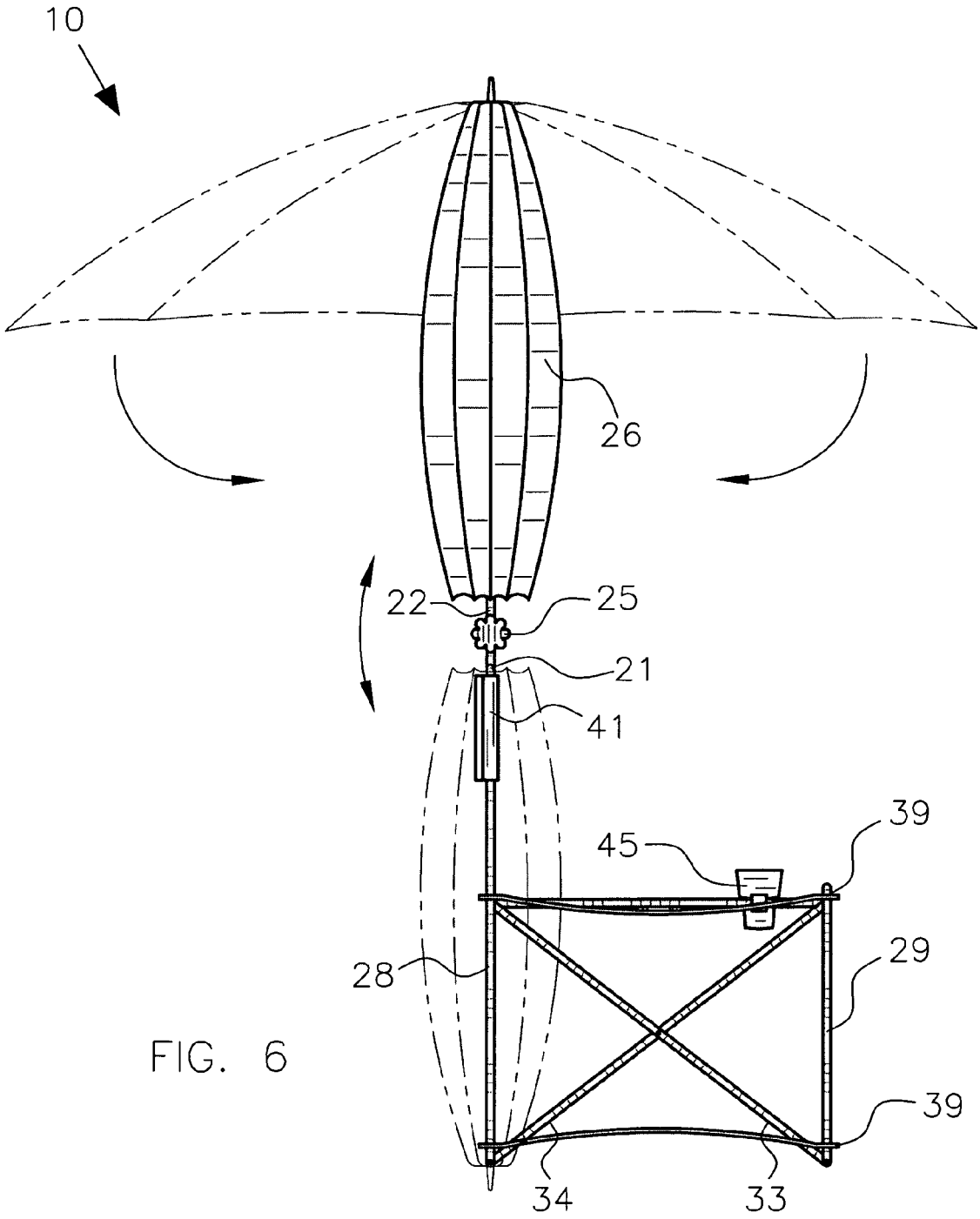
FIG. 6 is a side elevational view of a combination umbrella and folding chair, showing the compactability of the umbrella section, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-8 by the reference numeral 10 and is intended to provide a means for providing a barrier between a user and the sun or rain while the user employs the chair in outdoor environments. It should be understood that the assembly 10 may be used for many different types of outdoor activities and should not be limited in use to only those outdoor activities mentioned herein.

Referring initially to FIGS. 1, 2, 3 and 6, the combination umbrella and folding chair includes an umbrella section 20. Such an umbrella section 20 includes first and second rectilinear poles 21, 22 with axially opposed top and bottom ends 23, 24 respectively. Such a top end 23 of the first pole is hingedly attached directly, without the use of intervening characters, to the bottom end of the second pole, and such a bottom end 24 of the second pole locks into the top end of the first pole when the top end of the second pole is biased upwardly and away from the top end of the first pole. The second pole 22 is biased 180 degrees along an arcuate path defined about the hinged attachment point. The poles provide a means for extending the umbrella section above a user head.

The umbrella section further includes a rotatable knob 25 directly and simultaneously attached, without the use of intervening characters, to the top end 23 of the first pole and the bottom end 24 of the second pole. Such a knob 25 allows the user to maintain the second pole 22 in a fixed position at a multitude of discrete points along the arcuate path. Respective longitudinal lengths of the first and second poles 21, 22 are oriented collectively along a vertical plane which is essential such that the first and second poles are attached in an end-to-end sequence during operating conditions. The first and second poles 21, 22 abut directly against each other, without the use of intervening characters, along the respective longitudinal lengths thereof when the top end of the second pole is biased downwardly and toward the bottom end of the first section for storage and transport purposes. The umbrella section further includes a circular and flexible covering 26 provided with a center region statically connected to the top end of the second pole. Such a covering 26 has an outer circumference equidistantly spaced from the center region of the covering and the top end of the second pole respectively. The knob provides a means for adjusting the height of the poles per a user's preferences, and thereby securing the poles in that position.

Referring to FIGS. 1, 4, 5 and 8, the assembly further includes a chair section 27 directly attached to the umbrella section 20. Such a chair section 27 includes first, second, and third vertical support members 28, 29, 30. Such a first vertical support member 28 with a longitudinal length equal to the longitudinal length of the first pole 21 of the umbrella section, and each of the second and third vertical support members 29, 30 have equal longitudinal lengths that are less than the respective longitudinal lengths of the first pole 21 and the first vertical support 28. The chair section further includes first and second horizontal support members 31, 32 with axially opposed proximal and distal ends respectively and equal longitudinal lengths. Such a proximal end of the first horizontal support member 31 is hingedly attached to the first vertical support member 28 while the proximal end of the second horizontal support member 32 is telescopically and hingedly attached to the first pole 21 of the umbrella section. Such a distal end of the first horizontal support member 31 is hingedly attached to a top end of the second vertical support member 29 while the distal end of the second horizontal support member 32 is hingedly attached to a top end of the third vertical support member 30. The various support members provide a means for ensuring that the chair section provides steady support for a user.

The chair section further includes first and second crossed support members 33, 34 pivotally attached to each other at respective medial portions thereof. Each of such first and second cross members 33, 34 have equal longitudinal lengths respectively, and each of the first and second cross members have axially opposed top and bottom ends 35, 36 respectively. The top end 35 of the first cross member is telescopically and hingedly attached to the first pole 21 of the umbrella section. Such an attachment 37 is above the attachment of the proximal end of the second horizontal support member and abutted directly thereagainst, without the use of intervening characters. The bottom end 36 of the first cross member is detachably connected to a bottom end of the second vertical support member 29. The top end 35 of the second cross member 34 is hingedly attached to the top end of the third vertical support member. Such an attachment 38 is subjacent to the attachment of the distal end of the second horizontal support member and abutted directly thereagainst, without the use of intervening characters, and the bottom end of the second cross member is hingedly attached to a bottom end of the first vertical support member.

The chair section further includes a flexible and planar seat member 39 with axially opposed corners simultaneously connected to the first pole 21 of the umbrella section and the first, second, and third vertical support members 28, 29, 30 respectively which is important such that the seat member 39 spans therebetween during operating conditions. Such a seat member 39 has a top surface 40 in contact with the user body when the user is seated thereupon, and such a top surface 40 is maintained along a horizontal plane during operating conditions. The seat member 39 further includes a bottom portion 39 in contact with a ground surface, provided for thereby preventing the assembly from sinking into the ground surface when the invention is utilized at a beach setting. Such a bottom portion 39 further helps keep the assembly afloat when positioned in body of water, for example.

The first pole 21 of the umbrella section and the first, second, and third vertical supports 28, 29, 30 respectively are spaced from each other at a distance defined by the respective longitudinal lengths of the first and second horizontal support members 31, 32 and the respective longitudinal lengths of the first and second cross members 33, 34 respectively during operating conditions, and the first and second horizontal support members 31, 32 are spaced above a ground surface a distance defined by the respective longitudinal lengths of the second and third vertical support members 29,30 and the respective lengths of the first and second cross members 33, 34 during operating conditions. The seat member provides a means for comfortably supporting a user bottom.

The chair section further includes a flexible and planar backrest 41 provided with longitudinally opposed left and right ends 42, 43. Each of such left and right ends 42, 43 has a sleeve 44 formed therein and extending along an entire lateral width thereof, and the first vertical support member 28 is slidably interfitted within the sleeve 44 of the left end of the backrest 41 while the first pole 21 of the umbrella section is slidably interfitted within the sleeve 44 of the right end of the back rest 41 which is vital such that the backrest spans between the first vertical support member 28 and the first pole 21 of the umbrella section. The chair section further includes a ring-shaped cup holder 45 monolithically formed with an outer surface of the second horizontal support member 32 and spaced from the seat member 39. Such a cup holder 45 is located adjacent to the distal end of the second horizontal support member 32, and the cup holder 45 further has an opening 46 formed therein which is essential such that existing beverage containers of different sizes are nested therein during operating conditions. Such an opening 46 of the cup holder has a centrally registered axis oriented parallel with the vertical plane during operating conditions. The cup holder provides a convenient means for storing a beverage within reach of a user while a user sits in the chair portion of the assembly.

Figure 7:
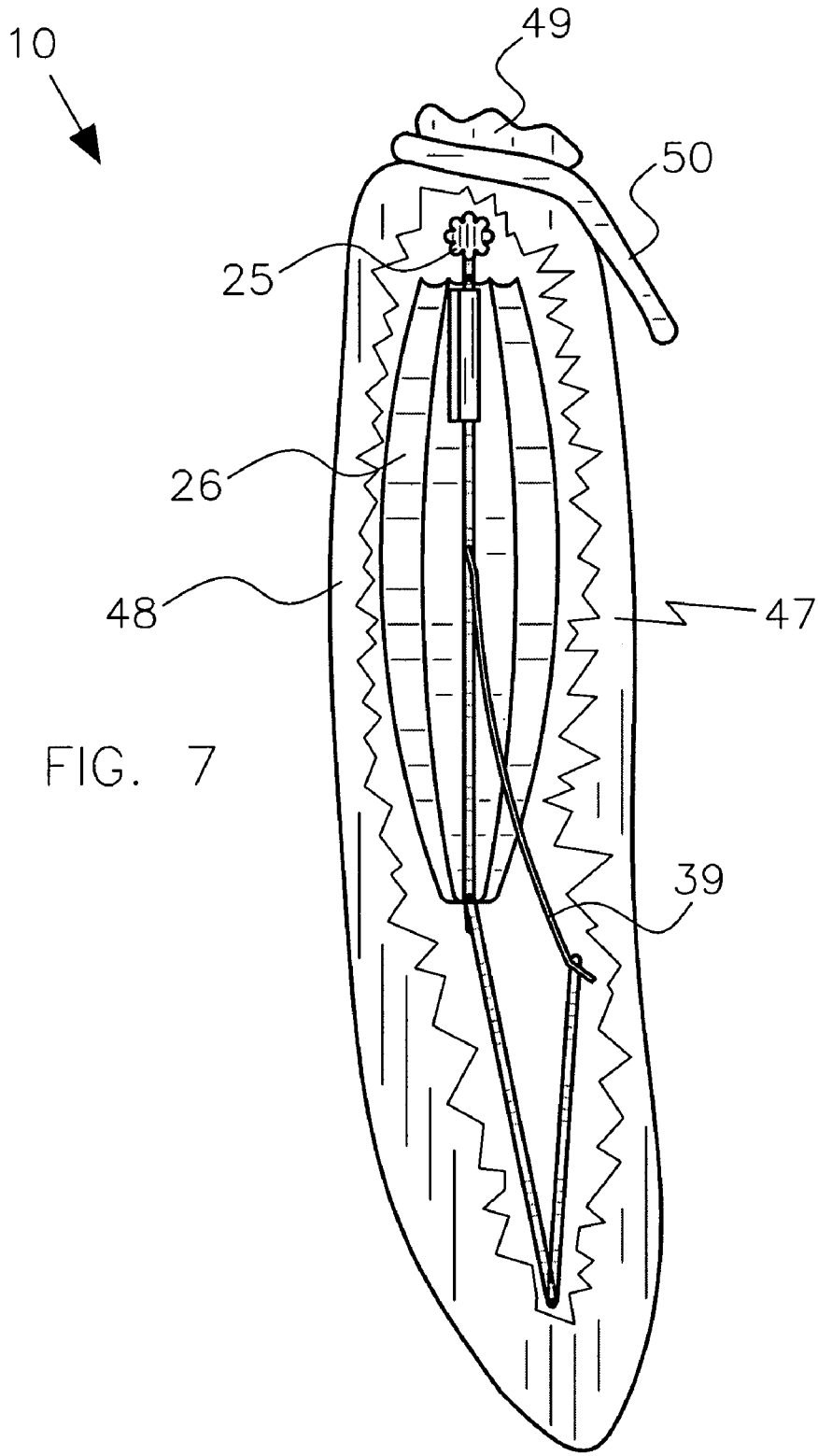
FIG. 7 is a cross sectional view showing the interior of the storing and transporting mechanism, and the assembly therein, in accordance with the present invention.
Figure 8:
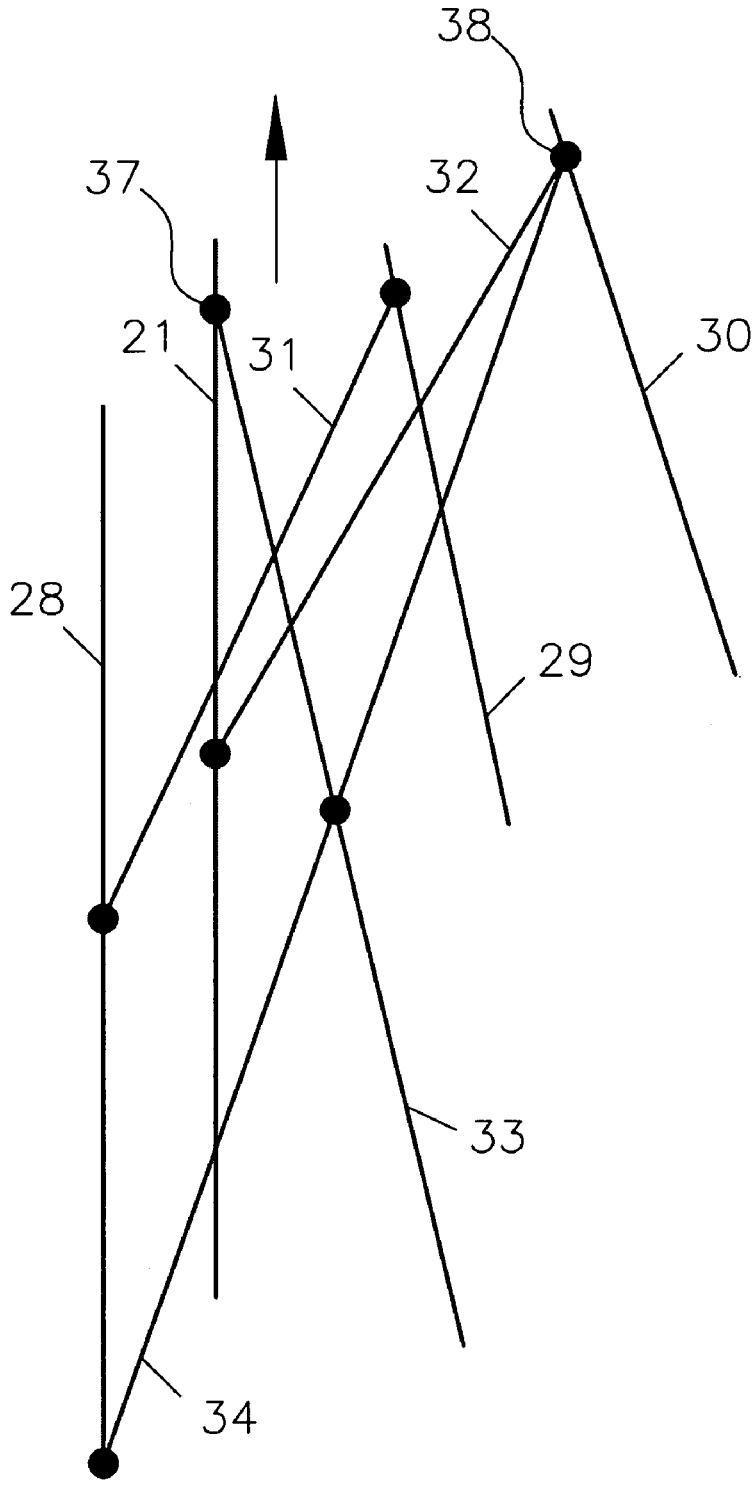
FIG. 8 is a schematic illustration showing the folding process of the chair section, in accordance with the present invention.

Referring to FIG. 7, the assembly further includes a mechanism for storing and transporting the umbrella section and the chair section simultaneously. Such a storing and transporting mechanism 47 is detachable from the umbrella section 20 and the chair section respectively during operating conditions. The storing and transporting mechanism 47 includes a deformably resilient and flexible bag 48 with an open top end 49. Such an open top end 49 allows the apparatus to be introduced into an interior of the bag 48, and the bag 48 is suitably shaped and sized which is crucial such that the apparatus is surrounded by the bag when the apparatus is introduced into the interior thereof during storage and transport procedures respectively. The second pole 22 is abutted directly against the first pole 21, without the use of intervening characters, along the respective longitudinal lengths thereof and the chair section 27 is in the collapsed position prior to introducing the apparatus into the interior of the bag. The storing and transporting mechanism provides a means for storing the entire assembly in one convenient package, thereby compacted in order to fit a user's car trunk.

The storing and transporting mechanism 47 further includes a drawstring 50 slidably attached to an outside surface of the open top end of the bag. Such a drawstring 50 maintains the open top end 49 in a closed position when the apparatus is introduced into the interior of the bag 48 which is necessary such that the apparatus is prohibited from prematurely and undesirably exiting the interior of the bag 48 during storage and transport procedures respectively. The bottom end of the second vertical support member 29 is detached from the bottom end 36 of the second cross member and the first horizontal support member 31 and the second vertical support member 29 respectively are simultaneously articulated upwardly and toward the first vertical support member 28 while the second horizontal support member 32 and the third vertical support member 30 respectively are simultaneously articulated upwardly and toward the first pole 21 of the umbrella section 20. The drawstring ensures that the storing and transporting mechanism remains in a securely closed position and also provides a means for conveniently carrying the mechanism.

The first and second vertical support members 28,29 and the first horizontal support member 31 respectively are forced toward the first pole 21 of the umbrella section and the second horizontal support member 32 and the third vertical support member 30 respectively which is crucial such that the chair section is in the collapsed position. The umbrella section 20 and the chair section 27 respectively abut against each other along respective longitudinal lengths thereof which are important such that the apparatus is introduced to the interior of the bag 48 during storage and transport procedures respectively.

The cup holder provides the benefit of allowing a user to keep a beverage within reach without needing to move from the chair. The umbrella portion is advantageously supported upon the chair, thereby preventing the need to setup both a chair and an umbrella. In addition, the storing and transporting mechanism provides the unexpected benefit of allowing a user to conveniently store the entire assembly within one easily stored container. Such benefits overcome the prior art shortcomings.

In use, a method for providing a barrier between a user and the sun or rain via a combination umbrella and folding chair employed in outdoor environments includes the steps of: providing an umbrella section 20; attaching a chair section 27 directly to the umbrella section; and storing and transporting the umbrella section and the chair section simultaneously. The storing and transporting mechanism 47 is detachable from the umbrella section and the chair section respectively during operating conditions.

In use, the method further includes the steps of: hingedly attaching a top end of a first rectilinear pole 21 directly to a bottom end of a second rectilinear pole 22 and locking the bottom end of the second pole 22 into the top end of the first pole 21 when the top end of the second pole 22 is biased upwardly and away from the top end of the first pole. Such a second pole is biased 180 degrees along an arcuate path defined about the hinged attachment point. The steps further include attaching a rotatable knob 25 directly and simultaneously to the top end of the first pole and the bottom end of the second pole. Such a knob 25 allows the user to maintain the second pole in a fixed position at a multitude of discrete points along the arcuate path.

In use, the steps further include connecting a circular and flexible covering 26 provided with a center region to the top end of the second pole. Such a covering 26 has an outer circumference equidistantly spaced from the center region of the covering and the top end of the second pole respectively, and respective longitudinal lengths of the first and second poles 21, 22 are oriented collectively along a vertical plane such that the first and second poles 21, 22 are attached in an end-to-end sequence during operating conditions. The first and second poles abut directly against each other, without the use of intervening characters, along the respective longitudinal lengths thereof when the top end 23 of the second pole is biased downwardly and toward the bottom end 24 of the first section for storage and transport purposes.

In use, the method further includes the steps of providing first, second, and third vertical support members 28, 29, 30. Such a first vertical support member 28 has a longitudinal length equal to the longitudinal length of the first pole of the umbrella section 20, and each of such second and third vertical support members 29, 30 have equal longitudinal lengths that are less than the respective longitudinal lengths of the first pole 21 and the first vertical support 28. The steps further include providing first and second horizontal support members 31, 32 with axially opposed proximal and distal ends respectively and equal longitudinal lengths. Such a proximal end of the first horizontal support member 31 is hingedly attached to the first vertical support member 28 while the proximal end of the second horizontal support member is telescopically and hingedly attached to the first pole of the umbrella section, and such a distal end of the first horizontal support 31 member is hingedly attached to a top end of the second vertical support member 29 while the distal end of the second horizontal support member is hingedly attached to a top end of the third vertical support member 30.

In use, the steps further include providing first and second crossed support members 33, 34 pivotally attached to each other at respective medial portions thereof. Each of such first and second cross members 33, 34 have equal longitudinal lengths respectively, and each of the first and second cross members further have axially opposed top and bottom ends 35, 36 respectively. The steps further include providing a flexible and planar seat member 39 with axially opposed corners simultaneously connected to the first pole 21 of the umbrella section and the first, second, and third vertical 28, 29, 30 support members respectively such that the seat member 39 spans therebetween during operating conditions. Such a seat member 39 has a top surface 40 in contact with the user body when the user is seated thereupon, and such a top surface 40 is maintained along a horizontal plane during operating conditions.

The top end of the first cross member 33 is telescopically and hingedly attached to the first pole 21 of the umbrella section. Such an attachment is above the attachment of the proximal end of the second horizontal support member and abutted directly thereagainst, without the use of intervening characters, and the bottom end of the first cross member is detachably connected to a bottom end of the second vertical support member. The top end of the second cross member 34 is hingedly attached to the top end of the third vertical support member 30. Such an attachment is subjacent to the attachment of the distal end of the second horizontal support member and abutted directly thereagainst, without the use of intervening characters, and the bottom end of the second cross member is hingedly attached to a bottom end of the first vertical support member.

The first pole 21 of the umbrella section 20 and the first, second, and third vertical supports 28, 29, 30 respectively are spaced from each other at a distance defined by the respective longitudinal lengths of the first and second horizontal support members 31, 32 and the respective longitudinal lengths of the first and second cross members 33, 34 respectively during operating conditions. The first and second horizontal support members 31, 32 are spaced above a ground surface a distance defined by the respective longitudinal lengths of the second and third vertical support members 29, 30 and the respective lengths of the first and second cross members 33, 34 during operating conditions.

In use, the method further includes the steps of providing a flexible and planar backrest 41 with longitudinally opposed left and right ends 42, 43. Each of such left and right ends has a sleeve 44 formed therein and extending along an entire lateral width thereof. The steps further include interfitting the first vertical support member 28, 29 within the sleeve 44 of the left end of the backrest and interfitting the first pole 21 of the umbrella section within the sleeve of the right end 43 of the back rest 41 such that the backrest 41 spans between the first vertical support member 28 and the first pole of the umbrella section.

In use, the method further includes the steps of providing a ring-shaped cup holder 45 monolithically formed with an outer surface of the second horizontal support member 32 and spaced from the seat member 39. Such a cup holder 45 is located adjacent to the distal end of the second horizontal support member. The steps further include nesting an existing beverage container within the cup holder 45. The cup holder 45 has an opening 46 formed therein with a centrally registered axis oriented parallel with the vertical plane during operating conditions.

In use, the method further includes the steps of: providing a deformably resilient and flexible bag 48 with an open top end and introducing the apparatus through the open top end of the bag 48 and into an interior of the bag. Such a bag 48 is suitably shaped and sized such that the apparatus is surrounded by the bag 48 when the apparatus is introduced into the interior thereof during storage and transport procedures respectively. The steps further include attaching a slidable drawstring 50 to an outside surface of the open top end of the bag 48. Such a drawstring 50 maintains the open top end in a closed position when the apparatus is introduced into the interior of the bag such that the apparatus is prohibited from prematurely and undesirably exiting the interior of the bag during storage and transport procedures respectively.

The second pole 22 is abutted directly against the first pole 21 along the respective longitudinal lengths thereof and the chair section is in the collapsed position prior to introducing the apparatus into the interior of the bag. The bottom end of the second vertical support member 29 is detached from the bottom end of the second cross member 34 and the first horizontal support member 31 and the second vertical support member 29 respectively are simultaneously articulated upwardly and toward the first vertical support member 28 while the second horizontal support member 32 and the third vertical support member 30 respectively are simultaneously articulated upwardly and toward the first pole 21 of the umbrella section. The first and second vertical support members 28, 29 and the first horizontal support member 31 respectively are forced toward the first pole 21 of the umbrella section and the second horizontal support member 32 and the third vertical support member 30 respectively such that the chair section is in the collapsed position. The umbrella section 20 and the chair section 27 respectively abut against each other along respective longitudinal lengths thereof such that the apparatus is introduced to the interior of the bag during storage and transport procedures respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combination umbrella and folding chair for providing a barrier between a user and inclement weather while the user employs the chair in outdoor environments, said combination umbrella and chair comprising:

an umbrella section;

a chair section directly attached to said umbrella section; and means for simultaneously storing and transporting said umbrella section and said chair section;

wherein said umbrella section comprises first and second rectilinear poles having axially opposed top and bottom ends respectively, said top end of said first pole being hingedly attached directly to said bottom end of said second pole, said bottom end of said second pole locking into said top end of said first pole when said top end of said second pole is biased upwardly and away from said top end of said first pole, said second pole being biased 180 degrees along an arcuate path defined about the hinged attachment point;

a rotatable knob directly and simultaneously attached to said top end of said first pole and said bottom end of said second pole, said knob for allowing the user to maintain said second pole in a fixed position at a multitude of discrete points along said arcuate path;

wherein respective longitudinal lengths of said first and second poles are oriented collectively along a vertical plane such that said first and second poles are attached in an end-to-end sequence during operating conditions;

wherein said first and second poles abut directly against each other along said respective longitudinal lengths thereof when said top end of said second pole is biased downwardly and toward said bottom end of said first pole for storage and transport purposes; and a circular and flexible covering provided with a center region statically connected to said top end of said second pole, said covering having an outer circumference equidistantly spaced from said center region of said covering and said top end of said second pole respectively;

wherein said chair section comprises first, second, and third vertical support members, said first vertical support member having a longitudinal length equal to said longitudinal length of said first pole of said umbrella section, each of said second and third vertical support members having equal longitudinal lengths that are less than the respective longitudinal lengths of said first pole and said first vertical support;

first and second horizontal support members having axially opposed proximal and distal ends respectively and equal longitudinal lengths, said proximal end of said first horizontal support member being hingedly attached to said first vertical support member while said proximal end of said second horizontal support member is telescopically and hingedly attached to said first pole of said umbrella section, said distal end of said first horizontal support member being hingedly attached to a top end of said second vertical support member while said distal end of said second horizontal support member is hingedly attached to a top end of said third vertical support member; and first and second crossed support members pivotally attached to each other at respective medial portions thereof, each of said first and second cross members having equal longitudinal lengths respectively, each of said first and second cross members having axially opposed top and bottom ends respectively;

wherein said top end of said first cross member is telescopically and hingedly attached to said first pole of said umbrella section, the attachment being above the attachment of said proximal end of said second horizontal support member and abutted directly thereagainst, said bottom end of said first cross member being detachably connected to a bottom end of said second vertical support member;

wherein said top end of said second cross member is hingedly attached to said top end of said third vertical support member, the attachment being subjacent to the attachment of said distal end of said second horizontal support member and abutted directly thereagainst, said bottom end of said second cross member being hingedly attached to a bottom end of said first vertical support member; and a flexible and planar seat member having axially opposed corners simultaneously connected to said first pole of said umbrella section and said first, second, and third vertical support members respectively such that said seat member spans therebetween during operating conditions, said seal member having a top surface in contact with the user body when the user is seated thereupon, said top surface being maintained along a horizontal plane during operating conditions;

wherein said first pole of said umbrella section and said first, second, and third vertical support members respectively are spaced from each other at a distance defined by said respective longitudinal lengths of said first and second horizontal support members and said respective longitudinal lengths of said first and second cross members respectively during operating conditions, said first and second horizontal support members being spaced above a ground surface a distance defined by said respective longitudinal lengths of said second and third vertical support members and said respective lengths of said first and second cross members during operating conditions.

2. The combination umbrella and chair of claim 1, wherein said chair section further comprises;

a flexible and planar backrest provided with longitudinally opposed left and right ends, each of said left and right ends having a sleeve formed therein and extending along an entire lateral width thereof, said first vertical support member being slidably interfitted within said left end of said backrest while said first pole of said umbrella section is slidably interfitted within said sleeve of said right end of said back rest such that said backrest spans between said first vertical support member and said first pole of said umbrella section.

3. The combination umbrella and chair of claim 2, wherein said chair section further comprises:

a ring-shaped cup holder monolithically formed with an outer surface of said second horizontal support member and spaced from said seat member, said cup holder being located adjacent to said distal end of said second horizontal support member, said cup holder having an opening formed therein such that existing beverage containers of different sizes are nested therein during operating conditions, said opening of said cup holder having a centrally registered axis oriented parallel with a vertical plane during operating conditions.

4. The combination umbrella and chair of claim 3, wherein said simultaneous storing and transporting means comprises:

a deformably resilient and flexible bag having an open top end, said open top end allowing said sections to be introduced into an interior of said bag, said bag being suitably shaped and sized such that said sections are surrounded by said bag when said sections are introduced into said interior thereof during storage and transport procedures respectively;

wherein said second pole is abutted directly against said first pole along said respective longitudinal lengths thereof and said chair section is in the collapsed position prior to introducing said sections into said interior of said bag; and a drawstring slidably attached to an outside surface of said open top end of said bag, said drawstring for maintaining said open top end in a closed position when said sections are introduced into said interior of said bag such that said apparatus is prohibited from prematurely and undesirably exiting said interior of said bag during storage and transport procedures respectively;

wherein said bottom end of said second vertical support member is detached from said bottom end of said second cross member and said first horizontal support member and said second vertical support member respectively are simultaneously articulated upwardly and toward said first vertical support member while said second horizontal support member and said third vertical support member respectively are simultaneously articulated upwardly and toward said first pole of said umbrella section, said first and second vertical support members and said first horizontal support member respectively being forced toward said first pole of said umbrella section and said second horizontal support member and said third vertical support member respectively such that said chair section is in the collapsed position;

wherein said umbrella section and said chair section respectively abut against each other along respective longitudinal lengths thereof such that said sections are introduced to said interior of said bag during storage and transport procedures respectively.

5. A combination umbrella and folding chair for providing a barrier between a user and inclement weather while the user employs the chair in outdoor environments, said combination umbrella and chair comprising:

an umbrella section;

a chair section directly attached to said umbrella section; and means for simultaneously storing and transporting said umbrella section and said chair section, said simultaneous storing and transporting means being detachable from said umbrella section and said chair section respectively during operating conditions;

wherein said umbrella section comprises first and second rectilinear poles having axially opposed top and bottom ends respectively, said top end of said first pole being hingedly attached directly to said bottom end of said second pole, said bottom end of said second pole locking into said top end of said first pole when said top end of said second pole is biased upwardly and away from said top end of said first pole, said second pole being biased 180 degrees along an arcuate path defined about the hinged attachment point;

a rotatable knob directly and simultaneously attached to said top end of said first pole and said bottom end of said second pole, said knob for allowing the user to maintain said second pole in a fixed position at a multitude of discrete points along said arcuate path;

wherein respective longitudinal lengths of said first and second poles are oriented collectively along a vertical plane such that said first and second poles are attached in an end-to-end sequence during operating conditions;

wherein said first and second poles abut directly against each other along said respective longitudinal lengths thereof when said top end of said second pole is biased downwardly and toward said bottom end of said first pole for storage and transport purposes; and a circular and flexible covering provided with a center region statically connected to said top end of said second pole, said covering having an outer circumference equidistantly spaced from said center region of said covering and said top end of said second pole respectively;

wherein said chair section comprises first, second, and third vertical support members, said first vertical support member having a longitudinal length equal to said longitudinal length of said first pole of said umbrella section, each of said second and third vertical support members having equal longitudinal lengths that are less than the respective longitudinal lengths of said first pole and said first vertical support;

first and second horizontal support members having axially opposed proximal and distal ends respectively and equal longitudinal lengths, said proximal end of said first horizontal support member being hingedly attached to said first vertical support member while said proximal end of said second horizontal support member is telescopically and hingedly attached to said first pole of said umbrella section, said distal end of said first horizontal support member being hingedly attached to a top end of said second vertical support member while said distal end of said second horizontal support member is hingedly attached to a top end of said third vertical support member; and first and second crossed support members pivotally attached to each other at respective medial portions thereof, each of said first and second cross members having equal longitudinal lengths respectively, each of said first and second cross members having axially opposed top and bottom ends respectively;

wherein said top end of said first cross member is telescopically and hingedly attached to said first pole of said umbrella section, the attachment being above the attachment of said proximal end of said second horizontal support member and abutted directly thereagainst, said bottom end of said first cross member being detachably connected to a bottom end of said second vertical support member;

wherein said top end of said second cross member is hingedly attached to said top end of said third vertical support member, the attachment being subjacent to the attachment of said distal end of said second horizontal support member and abutted directly thereagainst, said bottom end of said second cross member being hingedly attached to a bottom end of said first vertical support member; and a flexible and planar seat member having axially opposed corners simultaneously connected to said first pole of said umbrella section and said first, second, and third vertical support members respectively such that said seat member spans therebetween during operating conditions, said seat member having a top surface in contact with the user's body when the user is seated thereupon, said top surface being maintained along a horizontal plane during operating conditions;

wherein said first pole of said umbrella section and said first, second, and third vertical support members respectively are spaced from each other at a distance defined by said respective longitudinal lengths of said first and second horizontal support members and said respective longitudinal lengths of said first and second cross members respectively during operating conditions, said first and second horizontal support members being spaced above a ground surface a distance defined by said respective longitudinal lengths of said second and third vertical support members and said respective lengths of said first and second cross members during operating conditions.

6. The combination umbrella and chair of claim 5, wherein said chair section further comprises:

a flexible and planar backrest provided with longitudinally opposed left and right ends, each of said left and right ends having a sleeve formed therein and extending along an entire lateral width thereof, said first vertical support member being slidably interfitted within said sleeve of said left end of said backrest while said first pole of said umbrella section is slidably interfitted within said sleeve of said right end of said back rest such that said backrest spans between said first vertical support member and said first pole of said umbrella section.

7. The combination umbrella and chair of claim 6, wherein said chair section further comprises:

a ring-shaped cup holder monolithically formed with an outer surface of said second horizontal support member and spaced from said seat member, said cup holder being located adjacent to said distal end of said second horizontal support member, said cup holder having an opening formed therein such that existing beverage containers of different sizes are nested therein during operating conditions, said opening of said cup holder having a centrally registered axis oriented parallel with a vertical plane during operating conditions.

8. The combination umbrella and chair of claim 7, wherein said simultaneous storing and transporting means comprises:

a deformably resilient and flexible bag having an open top end, said open top end allowing said sections to be introduced into an interior of said bag, said bag being suitably shaped and sized such that said sections are surrounded by said bag when said sections are introduced into said interior thereof during storage and transport procedures respectively;

wherein said second pole is abutted directly against said first pole along said respective longitudinal lengths thereof and said chair section is in the collapsed position prior to introducing said sections into said interior of said bag; and a drawstring slidably attached to an outside surface of said open top end of said bag, said drawstring for maintaining said open top end in a closed position when said sections are introduced into said interior of said bag such that said apparatus is prohibited from prematurely and undesirably exiting said interior of said bag during storage and transport procedures respectively;

wherein said bottom end of said second vertical support member is detached from said bottom end of said second cross member and said first horizontal support member and said second vertical support member respectively are simultaneously articulated upwardly and toward said first vertical support member while said second horizontal support member and said third vertical support member respectively are simultaneously articulated upwardly and toward said first pole of said umbrella section, said first and second vertical support members and said first horizontal support member respectively being forced toward said first pole of said umbrella section and said second horizontal support member and said third vertical support member respectively such that said chair section is in the collapsed position;

wherein said umbrella section and said chair section respectively abut against each other along respective longitudinal lengths thereof such that said sections are introduced to said interior of said bag during storage and transport procedures respectively.

9. A method for providing a barrier between a user and inclement weather via a combination umbrella and folding chair employed in outdoor environments, said method comprising the steps of:

a. providing an umbrella section;

b. attaching a chair section directly to said umbrella section; and c. simultaneously storing and transporting said umbrella section and said chair section;

wherein step a. comprises the steps of:

i. hingedly attaching a top end of a first rectilinear pole directly to a bottom end of a second rectilinear pole;

ii. locking said bottom end of said second pole into said top end of said first pole when a top end of said second pole is biased upwardly and away from said top end of said first pole, said second pole being biased 180 degrees along an arcuate path defined about the hinged attachment point;

iii. attaching a rotatable knob directly and simultaneously to said top end of said first pole and said bottom end of said second pole, said knob for allowing the user to maintain said second pole in a fixed position at a multitude of discrete points along said arcuate path; and iv. connecting a circular and flexible covering provided with a center region to said top end of said second pole, said covering having an outer circumference equidistantly spaced from said center region of said covering and said top end of said second pole respectively;

wherein respective longitudinal lengths of said first and second poles are oriented collectively along a vertical plane such that said first and second poles are attached in an end-to-end sequence during operating conditions;

wherein said first and second poles abut directly against each other along said respective longitudinal lengths thereof when said top end of said second pole is biased downwardly and toward a bottom end of said first pole for storage and transport purposes;

wherein step b. comprises the steps of:

i. providing first, second, and third vertical support members, said first vertical support member having a longitudinal length equal to said longitudinal length of said first pole of said umbrella section, each of said second and third vertical support members having equal longitudinal lengths that are less than the respective longitudinal lengths of said first pole and said first vertical support;

ii. providing first and second horizontal support members having axially opposed proximal and distal ends respectively and equal longitudinal lengths, said proximal end of said first horizontal support member being hingedly attached to said first vertical support member while said proximal end of said second horizontal support member is telescopically and hingedly attached to said first pole of said umbrella section, said distal end of said first horizontal support member being hingedly attached to a top end of said second vertical support member while said distal end of said second horizontal support member is hingedly attached to a top end of said third vertical support member;

iii. providing first and second crossed support members pivotally attached to each other at respective medial portions thereof, each of said first and second cross members having equal longitudinal lengths respectively, each of said first and second cross members having axially opposed top and bottom ends respectively; and iv. providing a flexible and planar seat member having axially opposed corners simultaneously connected to said first pole of said umbrella section and said first, second, and third vertical support members respectively such that said seat member spans therebetween during operating conditions, said seat member having a top surface in contact with the user body when the user's is seated thereupon, said top surface being maintained along a horizontal plane during operating conditions;

wherein said top end of said first cross member is telescopically and hingedly attached to said first pole of said umbrella section, the attachment being above the attachment of said proximal end of said second horizontal support member and abutted directly thereagainst, said bottom end of said first cross member being detachably connected to a bottom end of said second vertical support member;

wherein said top end of said second cross member is hingedly attached to said top end of said third vertical support member, the attachment being subjacent to the attachment of said distal end of said second horizontal support member and abutted directly thereagainst, said bottom end of said second cross member being hingedly attached to a bottom end of said first vertical support member;

wherein said first pole of said umbrella section and said first, second, and third vertical support members respectively are spaced from each other at a distance defined by said respective longitudinal lengths of said first and second horizontal support members and said respective longitudinal lengths of said first and second cross members respectively during operating conditions, said first and second horizontal support members being spaced above a ground surface a distance defined by said respective longitudinal lengths of said second and third vertical support members and said respective lengths of said first and second cross members during operating conditions.

10. The method of claim 9, wherein step b. further comprises the steps of:

v. providing a flexible and planar backrest having longitudinally opposed left and right ends, each of said left and right ends having a sleeve formed therein and extending along an entire lateral width thereof;

vi. interfitting said first vertical support member within said sleeve of said left end of said backrest; and vii. interfitting said first pole of said umbrella section within said sleeve of said right end of said back rest such that said backrest spans between said first vertical support member and said first pole of said umbrella section.

11. The method of claim 10, wherein step b. further comprises the steps of:

viii. providing a ring-shaped cup holder monolithically formed with an outer surface of said second horizontal support member and spaced from said seat member, said cup holder being located adjacent to said distal end of said second horizontal support member; and ix. nesting an existing beverage container within said cup holder, said cup holder having an opening formed therein with a centrally registered axis oriented parallel with a vertical plane during operating conditions.

12. The method of claim 11, wherein step c. comprises the steps of:

i. providing a deformably resilient and flexible bag having an open top end;

ii. introducing said sections through said open top end of said bag and into an interior of said bag, said bag being suitably shaped and sized such that said sections are surrounded by said bag when said sections are introduced into said interior thereof during storage and transport procedures respectively; and iii. attaching a slidable drawstring to an outside surface of said open top end of said bag, said drawstring for maintaining said open top end in a closed position when said sections are introduced into said interior of said bag such that said sections are prohibited from prematurely and undesirably exiting said interior of said bag during storage and transport procedures respectively;

wherein said second pole is abutted directly against said first pole along said respective longitudinal lengths thereof and said chair section is in the collapsed position prior to introducing said sections into said interior of said bag;

wherein said bottom end of said second vertical support member is detached from said bottom end of said second cross member and said first horizontal support member and said second vertical support member respectively are simultaneously articulated upwardly and toward said first vertical support member while said second horizontal support member and said third vertical support member respectively are simultaneously articulated upwardly and toward said first pole of said umbrella section, said first and second vertical support members and said first horizontal support member respectively being forced toward said first pole of said umbrella section and said second horizontal support member and said third vertical support member respectively such that said chair section is in the collapsed position;

wherein said umbrella section and said chair section respectively abut against each other along respective longitudinal lengths thereof such that said sections are introduced to said interior of said bag during storage and transport procedures respectively.

* * * * *